US006202612B1

(12) United States Patent
Haag

(10) Patent No.: US 6,202,612 B1
(45) Date of Patent: Mar. 20, 2001

(54) SEAL FOR A SERVO MEDIUM OF A TORQUE TRANSMISSION DEVICE

(75) Inventor: Michael Haag, Nurnberg (DE)

(73) Assignee: INA Walzlager Schaeffler oHG (DE)

( * ) Notice: Subject to any disclaimer, the term of this patent is extended or adjusted under 35 U.S.C. 154(b) by 0 days.

(21) Appl. No.: 09/334,015

(22) Filed: Jun. 15, 1999

(30) Foreign Application Priority Data

Jun. 18, 1998 (DE) ..... 198 27 160

(51) Int. Cl.[7] ..... F01M 1/06

(52) U.S. Cl. ..... 123/90.34; 123/90.33; 123/90.37; 123/196 R

(58) Field of Search ..... 123/90.33, 90.34, 123/90.37, 196 R

(56) References Cited

U.S. PATENT DOCUMENTS

| | | | | |
|---|---|---|---|---|
| 3,193,334 | | 7/1965 | Porath . | |
| 4,258,673 | * | 3/1981 | Stoody, Jr. et al. | 123/90.34 |
| 4,840,149 | * | 6/1989 | Fujita | 123/90.34 |
| 5,209,193 | * | 5/1993 | Uchida et al. | 123/90.34 |
| 5,529,034 | | 6/1996 | Sone et al. . | |
| 5,537,961 | | 7/1996 | Shigeru et al. . | |
| 5,794,579 | * | 8/1998 | Moriya | 123/90.34 |
| 5,816,205 | * | 10/1998 | Moriya | 123/90.34 |
| 5,960,757 | * | 10/1999 | Ushida | 123/90.34 |
| 6,032,629 | * | 3/2000 | Uchida | 123/90.34 |

FOREIGN PATENT DOCUMENTS

| | | |
|---|---|---|
| 17 75 519 | 11/1971 | (DE) . |
| 3030540 | 3/1982 | (DE) . |
| 38 19 390 | 12/1989 | (DE) . |
| 39 01 167 | 7/1990 | (DE) . |
| 40 07 720 | 9/1991 | (DE) . |
| 02 43 791 | 11/1987 | (EP) . |

OTHER PUBLICATIONS

Roemer, "Der . . . Gleitlaoers", Konstruktion, 13, 1961, H.7, S. 262–267.

* cited by examiner

*Primary Examiner*—Thomas Denion
*Assistant Examiner*—Tu M Nguyen
(74) *Attorney, Agent, or Firm*—Bierman, Muserlian and Lucas

(57) ABSTRACT

A seal for a servo medium of a torque transmission device (2) in which sealing rings can be dispensed with by providing an annular sealing gap (12) which extends on both axial sides of a servo medium supply and by a special choice of materials and structural configuration in this region, the sealing gap (12) diminishes in size with increasing warming-up of the device (2) which diminution counteracts the decreasing viscosity of the servo medium.

11 Claims, 1 Drawing Sheet

SEAL FOR A SERVO MEDIUM OF A TORQUE TRANSMISSION DEVICE

FIELD OF THE INVENTION

The invention concerns a seal for a servo medium of a torque transmission device comprising an outer member having a bore into which at least one passage for the servo medium opens, a preferably rotationally symmetrical body such as an axle or a shaft which extends in the bore with a part of an outer peripheral surface, said body being preferably intersected by at least one channel per passage, said outer member and said body rotating relative to each other about a longitudinal axis of the body, or said body rotating about a longitudinal axis thereof in the bore of the outer member, an inlet of each channel being aligned to the respective passage so that a transfer of the servo medium is possible in defined angular positions or in all angular positions of the body and the outer member relative to each other, and a coefficient of thermal expansion of a material of the outer member being larger than that of a material of the body.

BACKGROUND OF THE INVENTION

Such seals for torque transmission devices are widely used in mechanical and automotive engineering. One use, for example, is for feeding servo medium to a device for the relative hydraulic angular adjustment of a camshaft of a valve train of an internal combustion engine. In such a device, disclosed in JP 04-252 814, the servo medium supply is effected via an outer web of a cylinder head of the internal combustion engine. The sealing of the torque transmission device is realized through the relatively large axial length of the sealing surface in the region of the passage through which the servo medium is fed and of an annular groove on the outer peripheral surface of the camshaft.

In other solutions provided by the prior art, sealing of the torque transmission device is accomplished by the use of sealing rings arranged on both sides of the passages or channels. However, such constructions have not only the drawbacks of complicated manufacturing, but, during operation of the device, it is also possible for these rings to "dig" into the opposing component or to produce undesired abrasion.

Prior art torque transmission devices have the general drawback that with increasing warming-up, the outer member having the bore expands to a greater extent than the body which extends with its outer peripheral surface in this bore. This is encountered, for example, if the outer member is made of an aluminum alloy and the body is made of a steel. Thus, with increasing temperature, the sealing gap between the parts to be sealed is disadvantageously enlarged. This leak effect is augmented by the fact that the viscosity of the servo medium decreases with rising temperatures. In addition, the thus improved rheological properties of the hydraulic medium also lead to increased leakage thereof.

OBJECTS OF THE INVENTION

It is an object of the invention to create a seal for a torque transmission device of the pre-cited type in which the mentioned drawbacks are eliminated and in which the leakage of servo medium remains at almost the same low level over all temperature ranges.

This and other objects and advantages of the invention will become obvious from the following detailed description.

SUMMARY OF THE INVENTION

The invention achieves the above objects by the fact that the body comprises in the region of the torque transmission device, a groove-shaped recess with which the body extends in the bore of the outer member, or the body comprises in the region of the torque transmission device, an annular extension which extends in an annular recess of the bore of the outer member, an annular leak gap for the servo medium is formed between side walls of the recess and adjoining end faces of the outer member or between end faces of the extension and adjoining side walls of the body, and the leak gap is dimensioned as a function of a combination of the materials of the outer member and the body so that an almost same, low level of leakage of servo medium is achieved over all operational temperatures of the torque transmission device.

In this way, a minimal gap formed between the side walls of the recess and adjoining end faces of the outer member is utilized as a leak gap for the servo medium. By an appropriate choice of the gap dimension at ambient temperature by the construction engineer, it is possible to obtain an almost constant leakage level of the servo medium over all temperature ranges occurring during the operation of the torque transmission device. Additional components such as the aforementioned sealing rings can be dispensed with. Moreover, the part of the outer peripheral surface of the body in the region of the torque transmission device does not need to be used as a sealing length so that a relatively small overall axial length of the torque transmission device can be realized. At the same time, an axial bearing is formed for the body/the shaft at the leak gap, and a radial bearing is formed between the outer peripheral surface of the body and the bore of the outer web.

The torque transmission device of the invention is directed, for example, to a device for the hydraulic adjustment of a camshaft relative to its drive pinion in an internal combustion engine. In such an arrangement, the servo medium is supplied to the device, for example, via webs of the cylinder head or by separate feed collars surrounding the camshaft. However, the scope of the invention is explicitly not limited only to seals for use in the aforesaid devices but it is also possible to use the invention in a variety of torque transmission devices, even in such in which the outer member and the body rotate relative to each other.

According to an advantageous feature of the invention, the inlet into the channel of the body is made as an annular groove in the outer peripheral surface of the body. Advantageously, this annular groove is delimited axially outwardly by a side wall of the recess. In a further advantageous embodiment of the invention, the inlet of the channel is made as an annular groove in the bore of the bearing shell and likewise delimited axially outwardly by a side wall of the recess. This measure is particularly advantageous from the manufacturing point of view.

It is proposed to make the outer member of an aluminum alloy and the camshaft of a steel. However, the important aspect for the invention is only a proper pairing of the materials concerned so that, with increasing warming-up of the components and a simultaneous reduction of viscosity of the servo medium, the annular leak gap diminishes in size so that the leakage of servo medium always remains at approximately the same level.

Finally, it is proposed to use a hydraulic medium such as engine oil as a servo medium because this is readily available if the seal of the invention is used in an internal combustion engine. However, it is also conceivable to use brake fluid or the like as a servo medium.

The invention will now be described more closely with reference to the appended drawings.

DETAILED DESCRIPTION OF PREFERRED EMBODIMENTS

Figure 1:
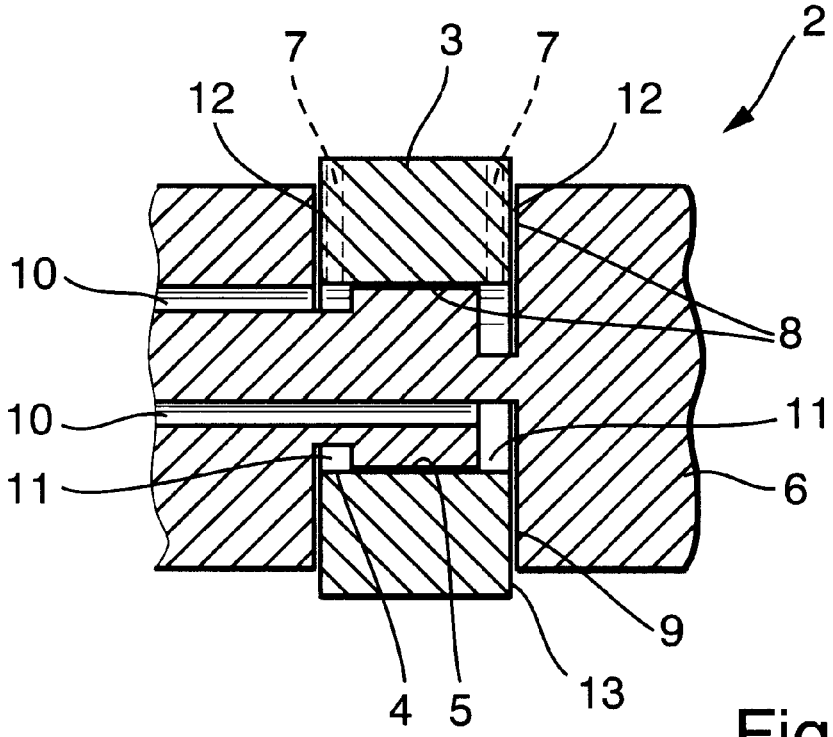
FIGS. 1 and 2 show advantageous embodiments of a seal of a torque transmission device which, in the illustrated sample, is a seal of a device for the hydraulic adjustment of a camshaft relative to its driving pinion installed in a valve train of an internal combustion engine.

FIG. 1 discloses a seal of a torque transmission device 2 for a servo medium which device 2 comprises an outer member 3 which is made in this case as a web of a cylinder head of an internal combustion engine. The outer member 3 comprises a bore 4 configured as a bearing shell and a rotationally symmetrical body 6 (camshaft) is supported in the bore 4 by a part of its outer peripheral surface 5. The body 6 rotates about its own axis in the outer member 3 and the bore 4 is intersected by two axially spaced passages 7 for the supply of servo medium.

The body 6 is provided in the region of the torque transmission device 2 with a groove-shaped recess 8 which is axially delimited by side walls 9. One channel 10 per passage 7 extends axially through the body 6, and each channel 10 possesses an inlet 11 which, in the present example, communicates with the passage 7 in every angular position of the body 6 relative to the outer member 3. In the embodiment of FIG. 1, the inlet 11 is configured as an angular groove. The axial spacing between the passages 7 is such that a delimitation of the inlet 11 is provided by the respective adjoining side wall 9.

In accordance with the invention, a sealing of the torque transmission device 2 is effected by a leak gap 12 formed between an end face 13 of the outer member 3 and the side walls 9 of the body 6. Since the outer member 3 is chosen so as to have a larger coefficient of thermal expansion than the body 6, an increase of temperature leads to a diminution of the seal gap 12 which diminution of the gap offsets, at least approximately, the reduction of viscosity of the servo medium caused by the rising temperature. As a result, an almost constant, low leakage of servo medium is achieved over all temperature ranges of the torque transmission device 2. No additional parts such as sealing rings are required and, moreover, the torque transmission device 2 can have a relatively short overall axial length because no axial sealing length is required on the outer peripheral surface 5.

Figure 2:
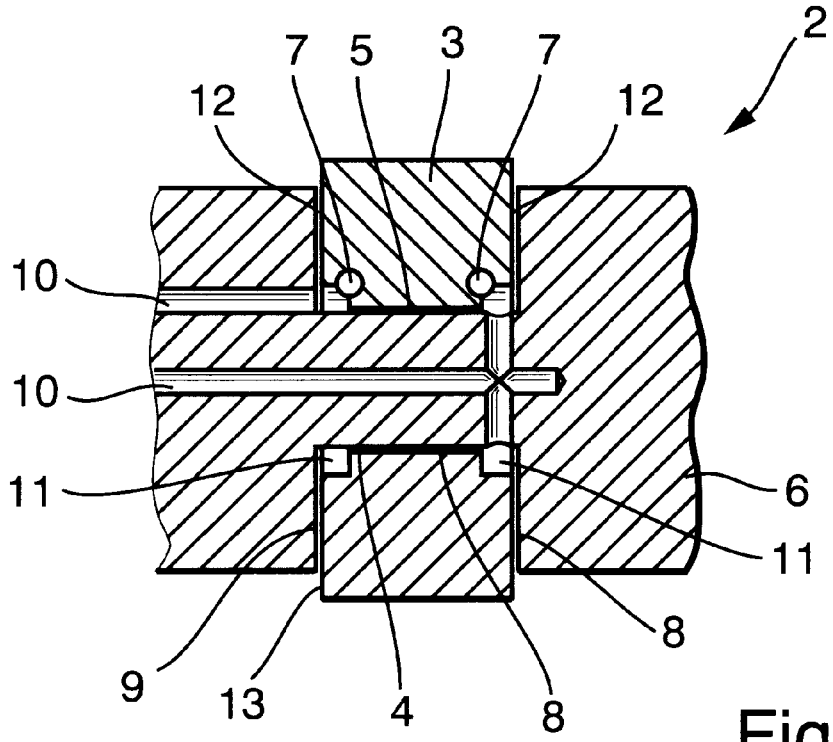

An alternative embodiment to that of FIG. 1 is shown in FIG. 2 wherein the inlet 11 of the channel 10 is configured as an annular groove in the bore 4.

Various modifications of the seal of the invention may be made without departing from the spirit or scope thereof and it is to be understood that the invention is intended to be limited only as defined in the appended claims.

What is claimed is:

1. A seal for a servo medium of a torque transmission device comprising:

a stationary member having a bore and a body rotating about a central longitudinal axis and extending in this bore with a part of an outer peripheral surface, a material of the body having a smaller coefficient of thermal expansion than that of the member, at least one passage for the servo medium opens into the bore of the member, while the body is intersected by one channel per passage of the member, an inlet of each channel being aligned to the respective passage, said inlet permitting a transfer of the servo medium from the member to the body at least in defined angular positions of the body and the member relative to each other, the part of the outer peripheral surface of the body extending in the bore is configured as a radial bearing surface of the body, which radial bearing surface has a diameter that is either equal to or, due to a groove-shaped recess, smaller than a diameter of the rest of the outer peripheral surface of the body, the radial bearing surface of the body is limited by an axial bearing of the body, which axial bearing is defined either by inner end faces of two annular extensions on the outer peripheral surface of the body or by side walls of the recess in the outer peripheral surface of the body, wherein:

a sealing between the member and the body of the torque transmission device is effected exclusively through two annular sealing gaps formed between the axial bearing of the body and side faces of the member, and a gap width of the sealing gaps can be decimated with rising operational temperature of the servo medium with utilization of a greater coefficient of thermal expansion of the material of the member compared to that of the body, so that through all operational temperatures of the servo medium an almost same, low level of leakage of servo medium is achieved.

2. A seal of claim 1 used in a device for a hydraulic adjustment of a camshaft relative to a drive pinion thereof, said device being installed in a valve train of an internal combustion engine, wherein the outer member is a web of a cylinder head or an element connected to the cylinder head and comprising a bore configured as a bearing shell in which the body made as a camshaft is mounted with a part of an outer peripheral surface, and wherein the at least one passage extends radially through the web to the bearing shell to supply the servo medium to at least one pressure chamber of the device.

3. A seal of claim 2 wherein the inlet of the channel is made as an annular groove in said part of the outer peripheral surface of the camshaft, which annular groove can be delimited axially outwardly by a side wall of the recess, and said channel extends axially through or along the camshaft and intersects the annular groove axially or radially.

4. A seal of claim 2 wherein the inlet of the channel is made as an annular groove in the bore of the bearing shell, which annular groove can be delimited axially outwardly by a side wall of the recess, and said channel extends axially through or along the camshaft and intersects the annular groove axially or radially.

5. A seal of claim 2 wherein the outer member/the bearing shell is made of an aluminum alloy and the body/the camshaft is made of a steel.

6. A seal of claim 2 wherein the servo medium is a hydraulic medium.

7. A seal of claim 1 wherein the outer member/the bearing shell is made of an aluminum alloy and the body/the camshaft is made of a steel.

8. A seal of claim 1 wherein the rotationally symmetrical body is an axle.

9. A seal of claim 1 wherein the rotationally symmetrical body is a shaft.

10. A seal of claim 1 wherein the servo medium is a hydraulic medium.

11. A seal of claim 10 wherein the hydraulic medium is engine oil.

* * * * *